United States Patent [19]

Schapira et al.

[11] Patent Number: 4,678,519

[45] Date of Patent: Jul. 7, 1987

[54] METHOD OF ZINC PHOSPHATIZATION, ACTIVATION AND REFINING BATH USED IN SAID METHOD AND CORRESPONDING CONCENTRATE

[75] Inventors: Joseph Schapira, Paris; Victor Ken, Colombes; Denis Théry, Deuil la Barre; Stéphane Jelodin, Argenteuil, all of France

[73] Assignee: Compagnie Francaise de Produits Industriels, Gennevilliers, France

[21] Appl. No.: 793,346

[22] Filed: Oct. 31, 1985

[30] Foreign Application Priority Data

Oct. 31, 1984 [FR] France ..... 84 16725

[51] Int. Cl.[4] ..... C23C 22/80

[52] U.S. Cl. ..... 148/6.15 Z; 148/6.15 R

[58] Field of Search ..... 148/6.15 R

[56] References Cited

U.S. PATENT DOCUMENTS

| | | | |
|---|---|---|---|
| 3,864,139 | 2/1975 | Heller | 106/287 R |
| 4,497,667 | 2/1985 | Uashi | 148/6.15 R |

FOREIGN PATENT DOCUMENTS

| | | | |
|---|---|---|---|
| 0031103 | 7/1981 | European Pat. Off. . | |
| 0084593 | 8/1983 | European Pat. Off. | 148/6.15 R |
| 0091627 | 10/1983 | European Pat. Off. . | |
| 3217145 | 11/1983 | Fed. Rep. of Germany . | |
| 0148140 | 11/1979 | Japan | 148/6.15 R |

*Primary Examiner*—Sam Silverberg

*Attorney, Agent, or Firm*—Fleit, Jacobson, Cohn & Price

[57] ABSTRACT

Method of zinc phosphatization of substrates essentially based on iron, zinc or their alloys, comprising successively:

(1) one or several alkaline degreasing steps,
(2) one or several rinsing steps with running city water,
(3) an activating and refining step,
(4) the zinc phosphatization step proper,
(5) one or several rinsing steps with water,
(6) preferably, a passivating final rinsing step, particularly by means of salts of hexavalent chromium or mixtures of hexavalent chromium and trivalent chromium characterized by the fact that, to carry out the activating and refining step, recourse is had to a bath comprising, besides the conventional constituents among which are particularly at least one Jernstedt salt in a proportion corresponding to about 1 to 100 ppm of titanium, a proportion of 10 to 700 ppm, preferably from 50 to 200 ppm, of at least one alkane-phosphonic acid of formula

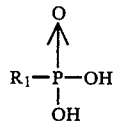

(I)

or at least one of the alkali or ammonium salts corresponding to the abovesaid alkane-phosphonic acids, the pH of the bath being from 7 to 9.5, preferably from 7.5 to 9.

10 Claims, No Drawings

METHOD OF ZINC PHOSPHATIZATION, ACTIVATION AND REFINING BATH USED IN SAID METHOD AND CORRESPONDING CONCENTRATE

The invention relates to an improved method of zinc phosphatization comprising:

(1) one or several alkaline degreasing steps,
(2) one or several rinsing steps with running city water,
(3) an activating and refining step,
(4) the zinc phosphatization step proper,
(5) one or several rinsing steps with water,
(6) preferably, a passivating final rinsing step, particularly by means of salts of hexavalent chromium or mixtures of hexavalent chromium and trivalent chromium and adapted to be applicable to the surfaces of objects based essentially on iron, zinc or their alloys.

The invention also relates to the activation and refining bath used in the said process and to the concentrate from which said bath is obtained.

It is recalled that the above defined phosphatization methods are for the purpose of conferring on surfaces, particularly steel, good resistance to corrosion, particularly after the application of paints of which the adherence is facilitated.

These phosphatization processes with zinc result in the formation on the metal surfaces concerned of a crystalline coating; this crystalline coating must be as fine and as dense as possible to obtain the best possible adherence of the subsequent paint layers, particularly in the case of paints of the electrophoretic type.

The steps particularly of activation and of phosphatization proper are carried out by means of suitable baths either by spraying, or by dipping, or by both spraying and dipping.

In the case of processes of the type concerned carried out entirely by jet, that is to say by spraying, step (3) may be omitted, the activation constituents then being introduced directly into the bath used for the alkaline degreasing step.

On the contrary, in the case of processes of the type concerned which preferably employ the total immersion or spraying/immersion operations here preferably contemplated, the maintenance of step (3) becomes indespensable to obtain a sufficiently fine and dense phosphatization.

Baths intended for carrying out the step of zinc phosphatization can contain, besides the zinc cation, other metals like nickel, manganese, calcium or possibly iron, as widely described in the scientific literature.

The refining agents employed at the time of the activating and refining step or which may be incorporated into the alkaline degreasing step when the method is operated entirely by jet are constituted by titane compounds, especially by colloidal titanium salts known under their connotation of Jernstedt salts and described for instance in U.S. Pat. No. 2,456,947.

Such a Jernstedt salt may be obtained by mixing 95 parts of disodium phosphate, 5 parts of potassium fluotitanate in a sufficient amount of water to dissolve the ingredients. The water is then driven from the mixture by evaporation at a temperature of 80° to 100° C.

Other sources of titanium may be used for the manufacture of the Jernstedt salt, like for example titanium sulfate or titanium oxide.

It is also possible to add polyphosphates to the Jernstedt salts, particularly in a proportion of 1 to 300 parts by weight of $P_2O_7$.

The Jernstedt salts are to be found currently in the trade and are in particular commercialized by Applicant Company under the manufacturing trademark "FIXODINE 5".

Due to the sensitivity of the Jernstedt salts with respect to the hardness of the water used to prepare the refining bath, there were used until now, in the methods of the type defined, either demineralized water or industrial water in which latter case it was usual to operate the bath by overflow with the addition of refining salt proportional to the amounts of water added.

Such a manner of operating is expensive in water and in active material, particularly when the phosphatization process is applied to the treatment of articles of large surface by immersion such as encountered in the automobile industry for body work, the treatment baths then being very voluminous and can currently reach volumes of 100 to 200 $m^3$.

It is a particular object of the invention to overcome these drawbacks and to adapt the phosphatization process of the type concerned in such an extent that, for the activating and refining step, industrial water can be used without recourse to overflow with the addition of refining salt proportional to the amounts of water added, while enabling an effect of refining and of stability comparable with that obtained in demineralized water.

Now, applicants have found that these objects could be achieved by incorporating into the bath used during the activating and refining step of an effective amount of at least one alkane phosphonic acid of formula (I) defined below or of a corresponding salt.

The above-mentioned formula I, to which corresponds the alkane-phosphonic acid employed according to the invention, is as follows:

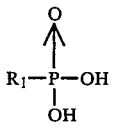

(I)

with $R_1$ representing an alkyle radical or an aryl radical possibly substituted by at least one of the substituents of the group comprising the hydroxyl radical, other phosphonic groups and amino groups of formula

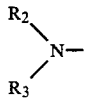

in which $R_2$ and $R_3$ may be identical or different from one another, each represent a hydrogen atom or have the meaning of $R_1$.

The salts of these acids which are useful are those obtained by partial or total neutralization by alkali ions such as $Na^+$ and $K^+$ or by the $NH_4^+$ ion.

By way of example of such a salt, that of the following formula (Ia) is indicated:

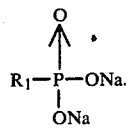

(Ia)

Among the alkane-phosphonic acids of formula (I), more particularly preferred are those of the group comprising:

hydroxymethylphosphonic acid
hydroxypropylphosponic acid
octylphosphonic acid
ethyl- and butylphosphonic acid
1-hydroxyethylidene-1,1-diphosphonic acid
amino-tri(methylenephosphonic) acid
ethylene-diamine-tetra(methylenephosphonic) and
2-phosphono-butane-1,2,4-tricarboxylic acid.

It follows that the method according to the invention is characterized by the fact that, in the activation and refining step is used a bath which comprises, besides the conventional constituents among which are particularly at least one Jernstedt salt in a proportion corresponding to about 1 to 100 ppm of titanium, a proportion of 10 to 700 ppm, preferably from 50 to 200 ppm, of at least one alkane-phosphonic acid of formula (I) or one of its salts, the pH of the bath being from 7 to 9.5, preferably from 7.5 to 9.

This bath also is an object of the invention.

To adjust the pH to the desired value, recourse may be had to suitable proportions of tartrates, phosphates, polyphosphates and alkaline carbonates.

Other constituents of the bath according to the invention may be pyrophosphate or alkali citrates.

Particularly advantageous refining baths are those of which the composition is indicated below:

Bain A 2 g/l of Jernstedt salt (FIXODINE 5)
60 ppm of the sodium salt of aminotri-(methylenephosphonic) acid
water q.s.

Bain B 2 g/l of Jernstedt salt (FIXODINE 5)
200 ppm of the sodium salt of phosphonic acid
water q.s.

Bain C 2 g/l of Jernstedt salt (FIXODINE 5)
50 ppm of 1-hydroxyethylidene-1,1-diphosphonic acid
water q.s.

To prepare these baths, the Jernstedt salt and phosphonic acid are successively introduced into the appropriate amount of water.

More generally and particularly in practice, these baths are prepared from concentrates containing the acid of formula (I) or its salt and Jernstedt salt in proportions such that its admixture with a suitable amount of water provides the activation and refining bath used according to the invention.

Advantageously, the said concentrate is in the form of two separate containers containing respectively, on one hand, the Jernstedt salt and, on the other hand, an aqueous solution of the phosphonic acid of formula (I) or of its salt, these two containers can then be coupled preferably in the form of what is generally called a treatment "kit"; this concentrate can also be offered in the form of a powder comprising:

from 1 to 5% by weight of titanium expressed as titanium (IV) in the form of titanium phosphate
from 2.5 to 10% by weight of phosphonic acid of formula (I)
from 89 to 92.5% by weight of sodium potassium phosphate.

An advantageous example of the said concentrate according to the invention is that of the formula:

titanium expressed as titanium (IV) in a form of titanium phosphate . . . 2% by weight
trisodium phosphate . . . 93% by weight
1-hydroxyethylidene-1,1-diphosphonic acid . . . 5% by weight.

The activation and refining step according to the invention is carried out at a temperature of 20° to 50° C.

The stability of the bath employed is sufficient for it to be operable at a normal rate without regeneration, that is to say without the addition of supplementary amounts of concentrate other than normal amounts to be added through consumption of the product, during about 5 to 15 days.

The other steps of the zinc phosphatization process according to the invention, are carried out conventionally.

The detailed description thereof is to be found particularly in French patent application No. 80 03185.

The invention will be still better understood by means of the examples described below and of which the two first are comparative examples bringing out the inherent advantages of the invention with respect to the prior state of the art.

In these examples, only the activation and refining step is described, the other steps being always the same, the succession of steps being as follows:

alkaline degreasing step by immersion in an aqueous bath including a composition based on alkali salts, namely marketed by Applicant Company under the manufacturing mark "RIDOLINE 1501" at 1.5% in weight/volume as well as a surface active agent namely that marketed by Applicant Company under the manufacturing mark "RIDOSOL 1501" at 1.15% by volume, the temperature being 60° C. and the duration 5 minutes;

step of rinsing with running city water at ambiant temperature;

refining step according to the invention by immersion for 1 minute at ambiant temperature;

zinc phosphatization step by means of an aqueous bath comprising a composition based on acid zinc phosphates, namely that marketed by Applicant Company under the manufacturing mark "GRANODINE 908" operating by immersion for 3 minutes, at 55° C.;

a rinsing step with running city water;

a drying step for 5 minutes under a hot air current at 80° C.

In these examples, the aim was to study the influence of different activation baths on the morphology of the zinc phosphate crystals deposited in the phosphatization step.

This morphology was examined by means of an electronic scanning microscope at a magnification of 1500.

Two examinations were carried out the first of which was done after treatment in a fresh bath, 10 minutes after its preparation and of which the second was carried out after treatment in the same bath, 6 days after the preparation of the latter.

EXAMPLE 1 (Comparative)

The activation bath comprised 2 g/l of Jernstedt salts (FIXODINE 5) in demineralized water corresponding to 20 ppm of titanium.

The other constituents were sodium phosphates.

The pH was 7.

EXAMPLE 2 (Comparative)

The same composition and same pH as in Example 1 but the water was constituted by tap water.

The pH was 7.9.

EXAMPLE 3

The activation bath comprises, in tap water:

2 g/l of Jernstedt salt (FIXODINE 5)

50 ppm of 1-hydroxyethylidene-1,1-diphosphonic acid, the resulting pH being 7.8.

EXAMPLE 4

The bath was identical with that of Example 3, with the slight difference that the phosphonic acid was present in the proportion of 100 ppm.

EXAMPLE 5

The bath was identical with that of Example 4, but the pH was brought to 9 with trisodium phosphate.

EXAMPLE 6

The activation bath comprises, in tap water:

2 g/l of Jernstedt salt (FIXODINE 5)

60 ppm of the sodium salt of aminotri(methylenephosphonic acid, the pH being 8.

EXAMPLE 7

The bath was identical with that of Example 6, with the difference that the sodium salt of the phosphonic acid was present in the proportion of 200 ppm.

EXAMPLE 8

The bath was identical with that of Example 7, with the difference that the phosphonic acid was present in the proportion of 100 ppm and the pH was then 7.

EXAMPLE 9

The activation bath comprises, in tap water:

2 g/l of Jernstedt salt (FIXODINE 5)

600 ppm of 2-phosphono-butane-1,2,4-tricarboxylic acid, the pH being adjusted to 9 with trisodium phosphate.

In all the examples, two specimens of automobile grade steel of dimensions 25×20 cm were treated.

The specimens so treated were examined by the electronic microscope, as indicated previously.

According to the relative size of the crystals, a mark from 1 to 5 was given, namely:

1: mark corresponding to maximum fineness (very fine crystals)

2: mark corresponding to fine crystals

3: mark corresponding to average crystals

4: mark corresponding to coarse crystals

5: mark corresponding to very coarse crystals.

The results found are collected in the following table.

| Example No. | First examination 10 minutes after preparation of the bath | Second examination After 6 days of the life of the bath |
|---|---|---|
| 1 (comparative) | Crystals mark 1 very dense | Crystals mark 2 dense |
| 2 (comparative) | Crystals mark 4 dense | Crystals mark 5 sparse |
| 3 to 5 | Crystals mark 1 very dense | Crystals mark 1 very dense |
| 6 | Crystals mark 2 very dense | Crystals mark 3 dense |
| 7 | Crystals mark 1 very dense | Crystals mark 3 dense |
| 8 | Crystals mark 2 dense | Crystals mark 3 dense |
| 9 | Crystals mark 1 very dense | Crystals mark 1 very dense |

From all of these results, it is deduced:

that the phosphonic acids employed according to the invention or their salts improved notably the density and the fineness of the crystals, that the results obtained were superior or equivalent to the results obtained with a preparation in demineralized water.

We claim:

1. In a method for the phosphatization with zinc of articles of large surface constituted by a metal selected from the group consisting of iron, zinc and their alloys, the said articles which are submitted successively to (1) at least one alkaline degreasing step, (2) at least one rinsing step with running city water, (3) an activating and refining step carried out by way of a bath having a pH from 7 to 9.5 and comprising in industrial water at least one Jernstedt salt in a proportion corresponding to about 1 to 100 ppm of titanium, (4) the zinc phosphatization step proper, (5) at least one rinsing step with water, being treated by immersion in the bath used in the activating and refining step, the improvement, which permits the use of industrial water despite of its hardness for the constitution of the said bath and without recourse to overflow necessitating the addition of Jernsted salt proportional to the amounts of water added, while enabling an effect of refining and stability comparable with that obtained in demineralized water and according to which improvement the said bath comprises a proportion of 10 to 700 ppm of at least one alkane-phosphonic acid of formula

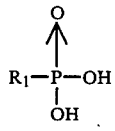

(I)

in which $R_1$ represents an alkyl radical or an aryl radical possibly substituted by at least one of the substituents of the group comprising the hydroxyl radical, other phosphonic groups and amino groups of formula

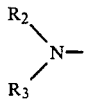

in which $R_2$ and $R_3$ may be identical or different from one another, each representing a hydrogen atom or having the significance of $R_1$, or at least one of the alkali or ammonium salts corresponding to the abovesaid alkane-phosphonic acids.

2. Method according to claim 1, comprising a passivating final rinsing step.

3. Method according to claim 1, comprising a passivating final rinsing step by means of salts of hexavalent chromium or mixtures of hexavalent chromium and trivalent chromium.

4. Method according to claim 1, wherein the bath used in the activating and refining step comprises a proportion from 50 to 200 ppm of at least one alkane-phosphonic acid of formula (I) or of the alkali or ammonium salt of the latter.

5. Method according to claim 1, wherein the alkane-phosphonic acid presented in the bath used in the activating and refining step is selected from the group consisting of hydroxymethylphosphonic acid
hydroxypropylphosphonic acid
octylphosphonic acid
ethyl- and butylphosphonic acid
1-hydroxyethylidene-1,1-diphosphonic acid
amino-tri(methylenephosphonic) acid
ethylene-diamine-tetra(methylenephosphonic) and
2-phosphono-butane-1,2,4-tricarboxylic acid.

6. Method according to claim 1, wherein the bath used in the activating and refining step has the following composition:

2 g/l of Jernstedt salt (FIXODINE 5)
60 ppm of the sodium salt of aminotri-(methylenephosphonic) acid
water q.s.

7. Method according to claim 1, wherein the bath used in the activating and refining step has the following composition:

2 g/l of Jernstedt salt (FIXODINE 5)
200 ppm of the sodium salt of phosphonic acid
water q.s.

8. Method according to claim 1, wherein the bath used in the activating and refining step has the following composition:

2 g/l of Jernstedt salt (FIXODINE 5)
50 ppm of 1-hydroxyethylidene-1,1-diphosphonic acid
water q.s.

9. Concentrate in the form of a powder to be diluted with water for the preparation of the bath used in the activating and refining step comprised by the method according to claim 1, said concentrate consisting of from 1 to 5% by weight of titanium expressed as titanium (IV) in the form of titanium phosphate
from 2.5 to 10% by weight of phosphonic acid of formula (I)
from 89 to 92.5% by weight of sodium potassium phosphate.

10. Concentrate in the form of a powder to be diluted with water for the preparation of the bath used in the activating and retaining step comprised by the method according to claim 1, consisting of:

2% by weight of titanium expressed as titanium (IV) in a form of titanium phosphate
93% by weight of trisodium phosphate
5% by weight of 1-hydroxyethylidene-1,1-diphosphonic acid.

* * * * *